United States Patent [19]

Damm et al.

[11] Patent Number: 4,588,017

[45] Date of Patent: May 13, 1986

[54] APPARATUS FOR COMPACTING MOLDING SAND USING PRESSURIZED GAS

[75] Inventors: Norbert Damm, Karlsrdorf-Neuthard; Alfons Köbel, Karlsruhe, both of Fed. Rep. of Germany

[73] Assignee: BMD Badische Maschinenfabrik Durlach GmbH, Karlsruhe, Fed. Rep. of Germany

[21] Appl. No.: 614,677

[22] Filed: May 29, 1984

[30] Foreign Application Priority Data

May 26, 1983 [DE] Fed. Rep. of Germany ..... 3319030

[51] Int. Cl.[4] ..... B22C 15/00

[52] U.S. Cl. ..... 164/169; 164/37

[58] Field of Search ..... 164/37, 15, 169, 38

[56] References Cited

U.S. PATENT DOCUMENTS 3,041,685 7/1962 Taccone ..... 164/37

3,170,202 2/1965 Huston, Sr. et al. ..... 164/37

FOREIGN PATENT DOCUMENTS 350571 10/1972 U.S.S.R. ..... 164/169

521993 9/1976 U.S.S.R. ..... 164/169

*Primary Examiner*—Nicholas P. Godici

*Assistant Examiner*—Samuel M. Heinrich

*Attorney, Agent, or Firm*—Antonelli, Terry & Wands

[57] ABSTRACT

An apparatus for the compaction of foundry sand using a pressurized gas method is made up of a conventional flask closed by a pattern plate with a pattern and has a filling frame and a chamber over the foundry sand heaped on the pattern. A high-speed filling of the chamber is carried out by gas under pressure in a matter of milliseconds so that the foundry sand is compacted while at the same time the pressure falls. In order to be certain of an even and reproducible compacting effect on the sand whatever way of producing the gas pressure is used, i.e. with or without an explosion of a gas mixture to get a gas pressure wave, use is made of a piston plate that is placed a small distance over the surface of the sand filling for separating the sand from the gas pressure space at least at the beginning of the action of the gas, such piston plate being freely movable and having an outline generally the same as the free cross section of the filling frame and the flask. The piston plate is returned to its initial position after sand compaction.

18 Claims, 5 Drawing Figures

APPARATUS FOR COMPACTING MOLDING SAND USING PRESSURIZED GAS

BACKGROUND OF THE INVENTION

The present invention relates to apparatus for the compaction of molding sand in mold production using pressurized gas and composed of a mold flask whose floor is formed by a pattern plate with a pattern and which has a filling frame placed on top of it. Over the filling frame or over the sand placed in the flask there is a chamber, that is suddenly pressurized in a matter of milliseconds so that the molding sand is compacted while at the same time there is a drop in the gas pressure.

DISCUSSION OF THE PRIOR ART

In recent times there has been no lack of attempts to replace the widely used jolting, squeezing and blowing methods, which have become generally accepted either separately or in combined versions, by purely pressurized gas mold making methods, in which the mold sand is heaped onto the pattern and is then compacted by a sudden gas pressure wave or impact acting on its free top face. In such a process there are two effects that are mainly responsible for the compaction, i.e. on the one hand the transmission of the kinetic energy of the pressure wave to the mass of mold sand, whose acceleration is caused by the exchange of momentum between the mold sand particles and by the deceleration thereof on the pattern plate, and on the other hand the penetration of the gas into the free pore volume between the molding sand particles, the internal friction so being decreased because of the fluidizing effect. Even although the physical laws governing this form of compaction are so far not fully understood, it is clear that the basic requirement is to keep up the greatest possible pressure gradient, which is a function of the available expansion pressure and the expansion time. Furthermore a certain mass flow of the gas taking into account the surface of the molding sand and mass thereof has to be produced. If produced with optimum process parameters the finished mold will have the highest degree of compaction or hardness in its part near the pattern, this having been caused by the sudden deceleration of the accelerated sand grains on the pattern and the pattern plate. Then there will generally be a decrease in the compaction towards the back of the mold, the back itself being, if at all, insufficiently compacted so that the molding sand has to be stripped off to a certain depth.

In the apparatus designed for use with this method, generally speaking two approaches have been adopted which differ from each other with respect to the way of generating the gas pressure impact or wave. In the one approach (see the German unexamined (Offenlegungsschrift) specification Nos. 1,961,234 and 3,202,395) gas or more specially air is allowed to expand out of a pressure receiver violently through a valve into the space over the molding sand filling, while in keeping with the second of the two approaches (see the U.S. Pat. No. 3,170,202 and German unexamined (Offenlegungsschrift) specification No. 2,949,340) this space is filled with an explosive gas mixture which is then exploded. In the first form of method a distinction is furthermore to be drawn between the high and low pressure versions, the former (see the said German specification No. 1,961,234) using receiver pressures of over 20 bar, and the low pressure method running on pressures under 10 bar. So far attempts to exploit the high pressure method have failed because of the expense of making machines capable of producing, and the complex design needed for controlling, such high pressures. In the case of the low pressure method, which is greatly to be preferred from the costs angle, there are certain troubles in connection with getting a high enough pressure gradient and gas mass flow, that make necessary large valve cross sections and ultra-fast valve opening. In such a method the reproducibility of the pressure parameters and the possible compaction effects are welcome.

It is of the nature of the second form of the method that there are certain troubles in connection with the handling of the explosive gas mixtures and systems for leading away the exhaust gases produced therefrom. Further troubles are likely to be encountered because of the temperatures developed which are such that the molding sand becomes dried out, more specially at the back of the mold. In fact, the degree of compaction and the reproducibility thereof are greatly dependent on precisely monitoring or controlling quantities and the quality of the gas mixing operation. It is more specially the last-named parameters which are hardly to be kept to exactly. Attempts have been made to take care of some of these troubles by producing the explosive gas mixture not right over the surface of the sand but by producing and igniting it at a more of less atmospheric pressure in a separate chamber so that the pressure wave then spreads through an open duct of the necessary cross section into the mold space, accelerating the air masses therein as it goes. However such modifications of the explosive gas method do not give the desired outcome.

A shortcoming common to the two methods is that there is a relatively large dead volume over the surface of the molding sand and the filling gas, i.e. air, only absorbs a fraction of the energy freed.

With a purely pressurized gas method using a low pressure there are furthermore the troubles noted in connection with valve design, while with the explosion method the troubles noted are likely with the foundry sand because of the thermal reaction.

OVERVIEW OF THE PRESENT INVENTION

Taking as its starting point the apparatus of the sort noted hereinbefore for the compaction of molding sand in methods of mold production using pressurized gas and composed of a mold flask whose floor is formed by a pattern plate with a pattern and which has a filling frame placed on top of it and in which over the filling frame or over the sand placed in the flask there is a chamber, that is suddenly pressurized in a matter of milliseconds so that the molding sand is compacted while at the same time there is a drop in the gas pressure, one purpose of the present invention is that of developing a design which, while on the one hand being simple in structure, may be relied upon to give constant and reproducible effects.

For effecting this and other objects a piston plate is placed a small distance over the surface of the filling of molding sand to separate, at least at the beginning of the action of the gas pressure, the molding sand from the chamber with the pressurized gas, such plate being freely movable at the time of expansion of the pressurized gas and having an outline generally the same as the free cross section of the filling frame or of the flask and being able to be returned after the compaction of the molding sand to its starting position.

The distance between the surface of the molding sand and the lower face of the piston plate may be precisely set in order on the one hand to keep the dead volume therebetween as low as possible and on the other hand to make certain that there is enough gas or air in the dead volume to get sand compaction by pressurized gas and not simply compaction by the force of the piston plate. In the albeit small dead volume there will be enough gas or air available to produce the fluidizing effect as noted.

In the case of the purely pressurized gas method there is the useful effect that no expensive valve construction is needed, seeing that the pressurized gas is caused to take effect directly on the piston plate itself. With the explosive gas method there is the useful effect that the exploded gases, with their harmful properties, do not take effect directly on the molding sand itself but on the piston plate. Even so however, the method is still to be looked upon as a gas pressure compaction method because of the distance between the piston plate and the surface of the molding sand. There is the useful effect not found with the known method that the piston plate averages out its kinetic energy to give an even distribution thereof over the cross section of the flask so that irregularities likely with known methods in the form of craters in the surface of the molding sand are no longer possible, and more specially the back of the mold will no longer have any soft patches. The saving in energy over the known methods is of the order of 50% because of the decrease in the size of the dead volume. In its starting position the piston plate will preferably be right over the top edge of the filling frame so that it will not be in the way of it and the flask when they are moved. For this reason it is then possible for flask and the filling frame to be filled with molding sand by moving them to a point outside the rest of the apparatus and filling them there, or moving the part of the apparatus over the filling frame together with the piston plate out of the way so that the filling frame and the flask are uncovered. Furthermore the piston plate may be joined to a return mechanism to move it back out of the filling frame after the compaction operation into its initial position.

Although in the method of compaction relying on the pressure of an explosion an insert (see the U.S. Pat. No. 3,170,202) may be placed between the flask with the sand filled into it, such insert having a number of piston-like stamps or punches which at the start are placed on the surface of the molding sand so that their top sides are acted upon by the pressure wave of the explosion, such a system is on the one hand not one compacting by gas pressure because there is no cushion of gas between the punches and the molding sand, while on the other hand such a construction with a large number of small pressing pistons may not be produced for practical use. Although attempts have been made (see the German examined (Auslegeschrift) specification No. 1,242,802) to drive a conventional multi-punch pressing head by a gas explosion in place of by a mechanical or fluid pressure system, such large masses to be accelerated make necessary the use of a gas mixture such as to produce a very violent explosive action, or if this is not possible, such very large volumes of gas have to be used that the apparatus becomes complex and bulky. Lastly attempts have been made on a laboratory scale (see "LITEJNOE PROIZVODSTBVO in DEUTSCH" (Liteynoe proizvodstvo in German) 1963, no. 3, pages 6 to 9) to cover the molding sand surface with a metal plate acted on by an impact piston that is accelerated by the explosion of a charge so that here as well the energy of the impact piston is transmitted to the piston plate, it again not being a question of gas compaction but rather more of a sort of compaction by mechanical force. This sytem may not be used in practice for normal sizes of flask.

In keeping with a preferred form of the invention the piston plate is designed as a free-flight piston and it has releasable means for locking it in its starting position. Such release may be effected by a drive or by the gas pressure coming into effect over the piston plate.

This form of the invention is more specially suited for the pressurized gas method because the space over the piston place may be filled with a gas such as air until the desired pressure, that may be very much greater than 20 bar, is produced so that the piston plate is accelerated under the action of the expanding gas and the gas cushion existing between it and the surface of the molding sand is compressed in the first part of the motion of the plate up to roughly the same pressure, such pressure being transmitted to the fill of molding sand and compacting same. It has been seen that this step not only gives a constant and reproducible hardness of the mold, but furthermore makes certain that the mold hardness changes over the height of the mold as is generally desired in the art so that the molding sand is hardest near the pattern and smoothly decreases in hardness towards the back of the mold so that there is the increase in the permeability for gas as needed for the casting operation in an upward direction.

The course or profile of the mold hardness may be further improved and controlled to good effect if the piston plate has shock absorbers for braking it when it has moved through a certain compaction stroke, such shock absorbers being adjustable if desired.

It is in this way that the mass of the piston plate may be uncoupled from the mass of the molding sand after a certain stroke so that its kinetic energy is not converted by braking on the already compacted molding sand into compaction energy, which might cause the back of the mold to become overly hard.

As part of a further useful development of the invention the piston plate has a downwardly running edge skirt so that there will always be an air cushion at the lower side of the plate and it will be possible to keep all the air in front of the plate from leaking out sideways during the compaction operation. The same effect is to be had if the lower side of the piston plate is upwardly sloped towards the middle so that the plate becomes thinner.

A still further outgrowth of the present invention is characterized in that the piston plate has transfer passages therein, that are opened during the compaction stroke so that on the one hand the acceleration of the piston plate may be controlled to reduce it because gas under pressure is able to make its way into the space in front of the piston plate, while on the other hand the fluidizing effect on the molding sand may be varied.

In keeping with one working example of the invention the transfer passages are placed between the piston plate and the inner face of the filling frame and are shut down by overlapping seals on the filling frame under the effect of the pressurized gas. It is only at the instant at which the locking effect is overcome and the piston plate is let go of that the plate moves clear of these seals as well so that the transfer passages at the edge are uncovered.

In place of this system it is furthermore possible for the transfer passages to be placed in the piston plate and for them to be covered over, at least in the starting position, by closures so that in the starting position the full pressure will take effect on the piston plate. The closures may be fixed in position so that when it is accelerated the piston plate is lifted clear of them and the next part of the compaction stroke is generally only caused by its kinetic energy. However it is furthermore possible for the closures to be moved along as well for part of the compaction stroke and for them to be caught or intercepted later so that the instant, at which the pressurized gas may flow into the space in front of the piston plate, may be varied as desired.

As part of a further part of the invention the piston plate may be fitted with a preferably hollow guide piston running into the pressurized gas space, such guide piston being for example in the form of a guide cylinder and forming part of the pressurized gas chamber itself.

Such a guide cylinder may either have the same cross section as the piston plate and for this reason as the filling frame or it may be in the form of a cylinder, in which case it is best made with transfer passages, that at the beginning of the compaction stroke form a connection between the space inside the guide cylinder and the free space present outside the guide cylinder and over the piston plate in order to cause the pressure to take effect over all of the piston plate.

These forms of the invention may be used with equally useful effects not only in pressurized gas systems but furthermore in those working on explosive gas mixtures.

In keeping with a still further convenient form of the invention, the piston plate is such that it may be exchanged for a different plate so that adaptation in respect of its mass and/or its form to suit different foundry patterns and/or cross sections of mold flask becomes possible. To this end the piston plate may be positioned within a special insert, that at the same time may have locking means and will be replaced by another insert with a different piston plate when the pattern or the flask is changed.

As was noted at the start of the present account, in an explosion method the evenness and the reproducibility of the compaction is more specially dependent on the quality of the mixing of gases to be ignited, which for safety reasons will be undertaken only when the gases are in the apparatus. In the known method (see the said German specification No. 2,949,340) a fan is placed in the explosion chamber to make certain that mixing is thorough. In this case however the intensity and quality of the mixing operation is dependent not only on the design of the fan but furthermore on the explosion chamber geometry, the sort of gases used, etc. The present invention now makes it possible for the explosive mixture to be generated and to be ignited right over the piston plate and without causing any undesired effects when the molding sand is compacted. One form of mixing procedure that has turned out to be specially efficient and low in costs is one in which the gas components are each injected into the chamber over the piston plate with a spinning or vortex flow and are mixed with each other by free turbulence. This mixing technique, that has been used in another connection (see the German unexamined (Offenlegungsschrift) specification No. 1,557,215) offers the beneficial effect that, while not having moving mixing parts, it makes do with a minimum consumption of energy because the amount of kinetic energy only stems from an externally produced pressure gradient of the gases for combustion that are under a low gage pressure.

In keeping with a still further working example of this alternative form of the invention, there is a free turbulence mixer placed in the space over the piston plate, such mixer being formed by a downwardly opening tube which is inwardly drawn at its opening and which is furthermore, which is outwardly flared like a ring in its top shut-off part, the inlet opening for at least one gas component into the ring-like space being tangential. The other gas component may be blown in either upwardly and axially or tangentially in the top ring-like part of the mixer tube, such tangential injection best being in the opposite direction to the direction of the other gas component.

In this respect it is possible for a first stage of mixing to be caused in the chamber over the free turbulence mixer and the first stage mixture to expand into the free turbulence mixer or for only one of the gas components to be stored in an amount as needed for the explosion under gage pressure and to cause it to make its way into the ring-like space of the mixer while the other component is transferring into such ring-like space.

Further useful effects and details of the invention will be seen from the account now to be given using the figures.

LIST OF THE DIFFERENT VIEWS OF THE DRAWINGS

DETAILED ACCOUNT OF WORKING EXAMPLES OF THE INVENTION

Figure 1:
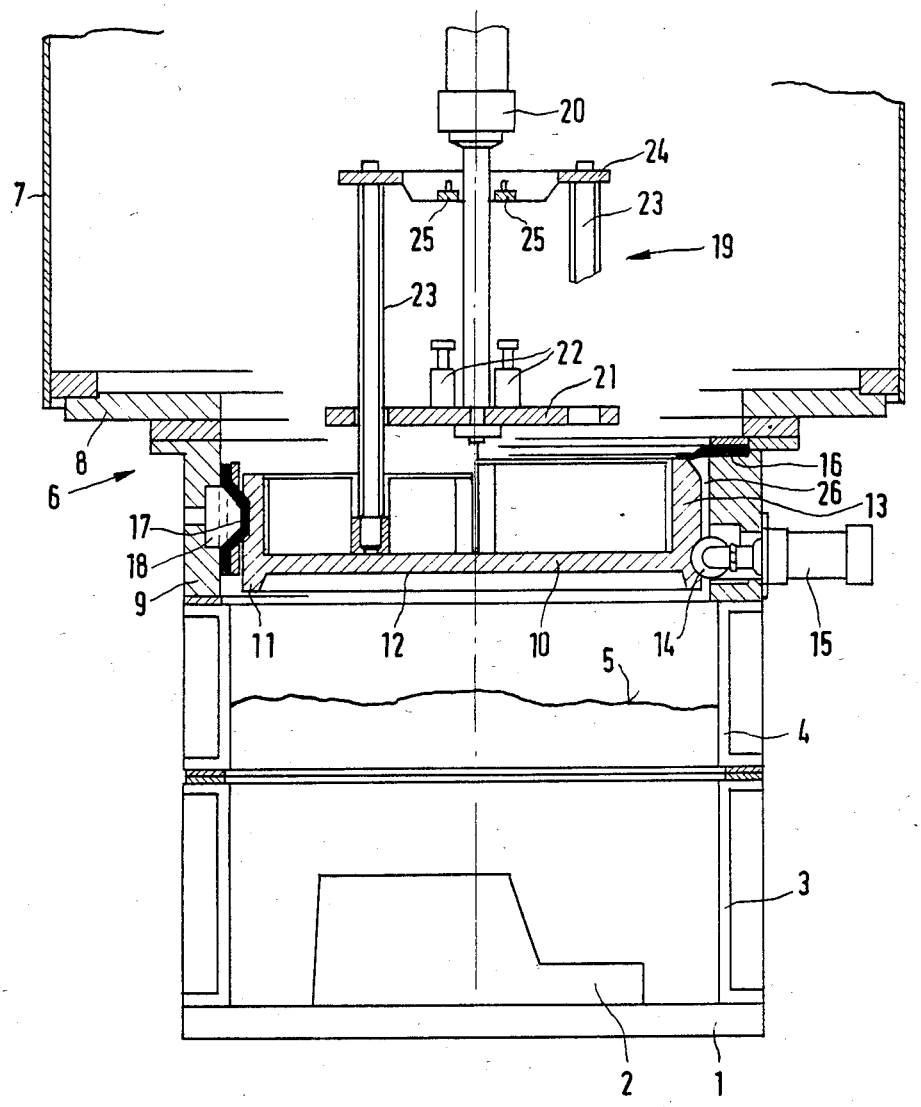
FIG. 1 is a view of two working examples of the invention with releasable locking means for the piston plate.

In the figures the reader will be able to see a diagrammatic representation of an apparatus with a pattern plate 1 and with a foundry pattern 2 and a flask 3 placed on the pattern plate 1. Furthermore there is a filling frame 4 place on the flask 3. The pattern plate 1 is rested on a lifting table, not marked, by way of which the flask 3 and filling frame 4 may be moved right up against the compaction unit 6 as such after the molding sand has been heaped onto the pattern 2. The surface of the heaped sand filling is marked 5 in FIG. 1.

The compaction unit 6 is composed of a pressure receiver 7 whose floor 8 is joined by way of flange to a frame 9, against which the filling frame 4 is moved in the compaction position. Within the frame 9 there is a piston plate 10, that on its lower side 12 has a downwardly drawn edge 11 or short skirt, such skirt furthermore running upwards above the level of the piston plate as a rim 13. The outline of the piston plate 10 and of its rim 13 is generally equal in size to the free cross section of the filling frame 4 and of the flask 3.

The piston plate 10 is locked in its starting position as viewed in FIG. 1. The locking effect may be produced for example (see right side of figure) by a roller 14 or a ball, that is moved by a spring or more specially by a pneumatic cylinder 15 into a pocket therefor in the rim 13 of the piston plate 10. The gap between the rim 13 of the piston plate 10 and the frame 9 is sealed off by a gasket 16, that is placed between the frame 9 and the floor 8 of the pressure receiver 7 and is rested on the top end face of the rim 13.

Another possible form of the releasable locking means and of the gasket is to be seen in the left half of FIG. 1, in which there is an elastic ring 17 fixed to the frame 9 and shutting off a pressure chamber 18. By supplying fluid under pressure into the chamber 18 the elastic ring 17 is forced into a hollow therefor in the rim 13 of the piston plate 10 and so seals off the gap.

In FIG. 1 the reader will furthermore see a return mechanism 19 having a fluid pressure cylinder 20, whose piston rod is moved out before the compaction stroke and has a plate 21 with shock absorbers 22 on its end. A number of rods 23 are fixed to the piston plate 10 of the compaction unit 6 and the top ends of the rods 23 are furthermore joined with each other by a frame 24. There are knocker sections 25 on the frame 24 that cooperate with the shock absorbers 22 on the plate 21.

The form of the invention to be seen in FIG. 1 is more specially designed for compaction using pressurized gas, that is to say, the pressure receiver 7 is filled with gas, such as for example compressed air, up to a maximum pressure of 20 bar and more specially under 8 bar (that is to say the regular line pressure in a plant) with the piston plate 10 in the initial position to be seen in FIG. 1. After the filling operation the locking means 14 and 15 or 17 and 18 is released and the piston plate 10 is violently accelerated, the gas in the pressure receiver 7 then suddenly expanding. When this happens the piston plate 10 compresses the air between its lower face 12 and the top face 5 of the foundry sand to the same pressure level. This in turn is responsible for a compaction of the foundry sand. The compaction stroke of the piston plate 10 is limited by the shock absorbers 22, which the knock sections 25 of the frame 24 run up against. Nextly the piston plate 10 is lifted by lifting the plate 21 by way of the pressure cylinder 20 back into its initial position and is locked.

In the working example of the invention to be seen in FIG. 1 there are transfer passages 26 between the rim 13 and the frame 9, that are opened at that instant at which the piston plate 10 starts its compaction stroke, seeing that at this time the sealing means 16 or 17 stops having any effect. For this reason, after a certain stroke there is an equalisation of pressure between the spaces in front of and to the back of the piston plate 10 so that the piston plate 10 is not accelerated any further, more specially in the last part of the compaction stroke. By making the right adjustment of the shock absorbers 22 it is more specially possible to stop the piston plate 10 from being only braked by the foundry sand towards the end of the compaction stroke, something which otherwise in certain cases would be likely to make the back of the mold hard, this not being desired.

Figure 2:
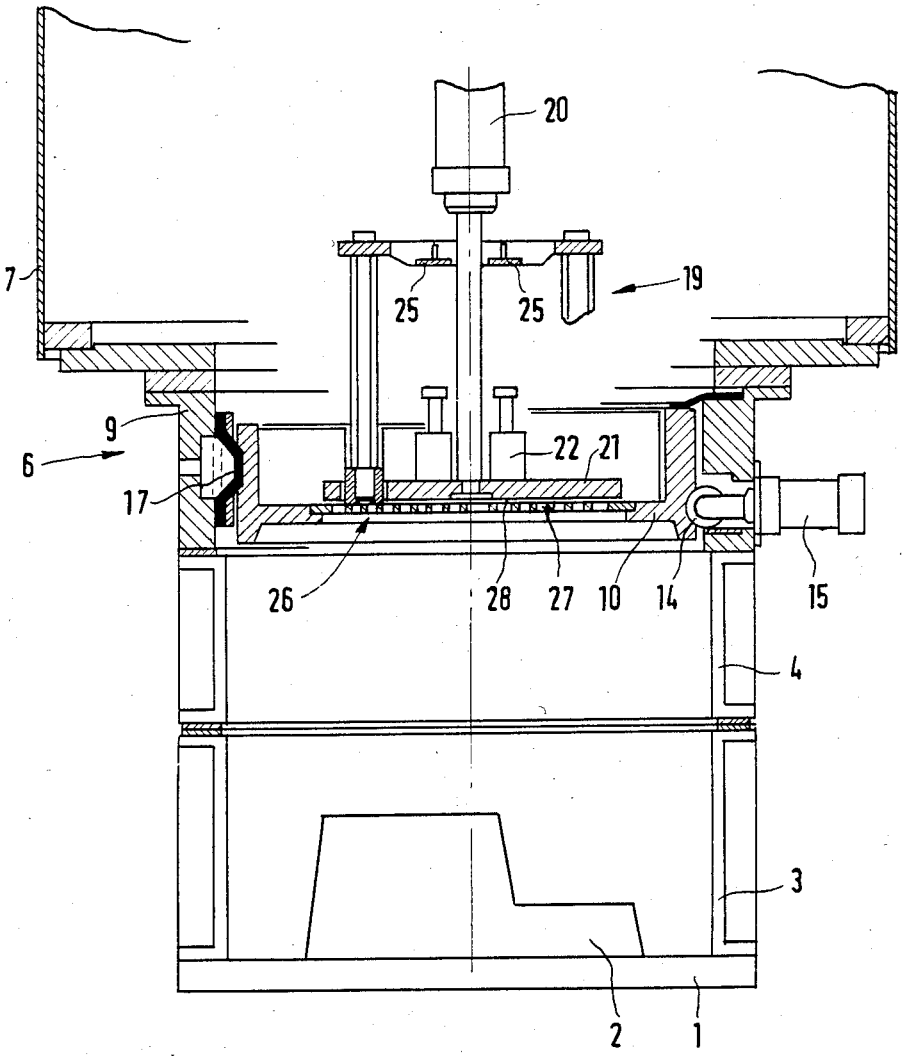
FIG. 2 is a view of the example as in FIG. 1 with a transfer passages in the piston plate.

The working example of FIG. 2 differs from that of FIG. 1 only in that the transfer passages 26 are differently constructed. The piston plate 10 does in this case have a middle opening 27 in which there is a perforated plate 28. This perforated plate 28 is covered over in the initial position of FIG. 2 by the plate 21 of the return mechanism 19 so that at the instant of undoing the locking means 14 and 15 or 17 the piston plate 10 will firstly be acted upon by the full pressure of the gas in the pressure receiver 7. After the return plate 21 has been raised there will then be an equalisation of pressure between the said pressure receiver 7 and the gas cushion in front of the piston plate 10 so that the acceleration of the piston plate 10 with time will be somewhat less and the piston plate will be run against the foundry sand with less kinetic energy, if it has not been intercepted earlier by the shock absorbers 22.

Figure 3:
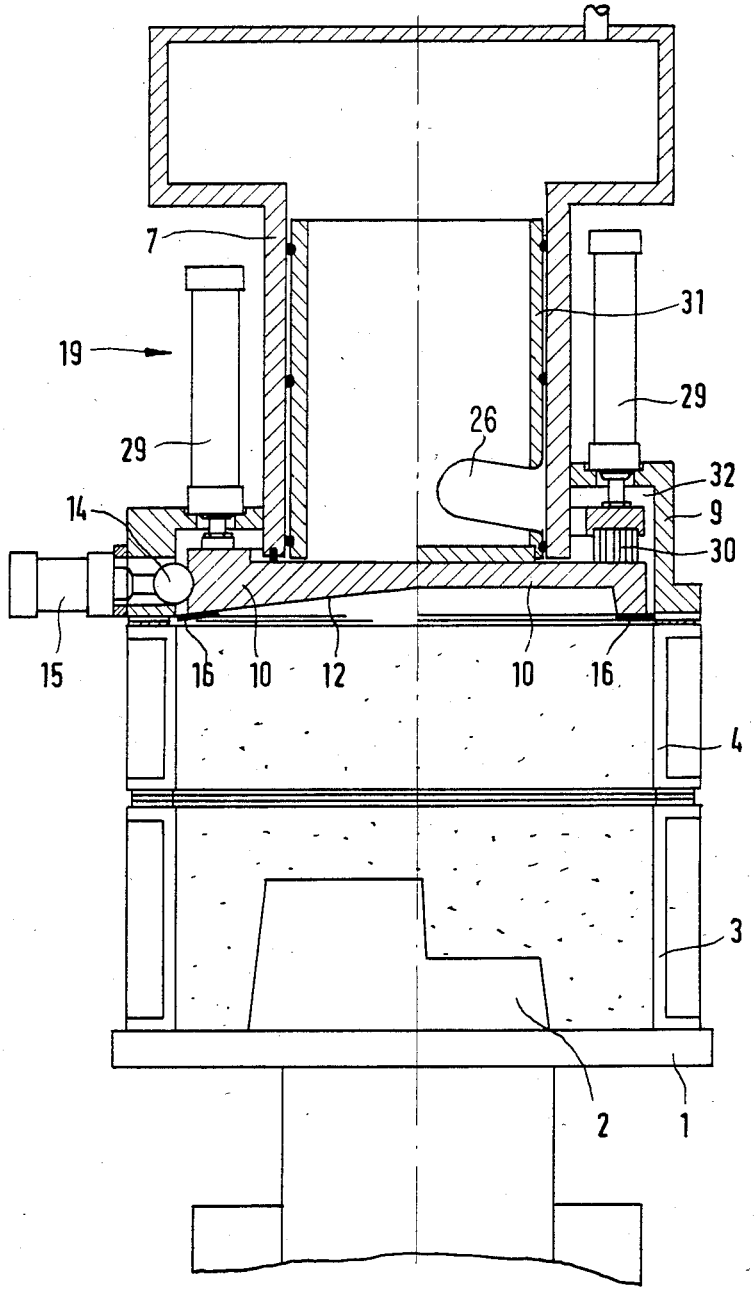
FIG. 3 is a view of a further working example of the apparatus for use in the explosion method of mold production.

In the working example of FIG. 3 the reader will first see a different design of the piston plate 10, whose lower face 12 is sloped upwards from the outside towards the middle so that the plate 10 becomes thinner. Furthermore in this example the gaskets 16 are as well rested against the lower face of the piston plate 10. In the left half of the figure a locking means 14 and 15 like that of FIGS. 1 and 2 will be seen, whereas the return mechanism 19 is only composed of a pressure cylinder 29, as for example an air-driven ram acting directly against the piston plate 10 (left half of the figure) or has a magnetic head 30 on its piston rod, such head 30 resting against the top face of the piston plate 10.

In this example of FIG. 3 the piston plate 10 has a hollow cylinder 31 with a circular cross section as a guide cylinder, which is guided in the pressure receiver 7, whose bottom part at least is correspondingly cylidrical. For this reason the inside of the guide cylinder 31 at the same time forms a part of the pressure receiver. Furthermore the guide cylinder 31 has an opening 26 functioning as a transfer passage as soon as it gets as far as the lower edge of the pressure receiver 7.

At this instant a connection is produced between the pressure receiver 7 or the space inside the guide cylinder 31 and the outer space 32 in the frame 9, that is positioned over the outer part of the piston plate 10.

In the working example to be seen in the right half of FIG. 3 the electromagnet 30 is turned off after filling up the pressure receiver 7 so that the piston plate 10 is accelerated. After the completion of the compaction stroke the piston rod of the pressure cylinder 29 is moved wtih a follow-up motion till the excited electromagnet 30 holds the piston plate 10 and the same may be returned. In the design to be seen on the left hand side the locking means 14 and 15 (as in FIGS. 1 and 2) is released after the charging of the pressure receiver 7. The fluid cylinder 29 may be used at the same time as a shock absorber if a pressure cushion is built up therein as the compaction stroke takes place, such pressure build-up then braking and slowing down the piston plate 10. For returning the piston plate 10 the fluid cylinder 29 is driven in the opposite direction.

Figure 4:
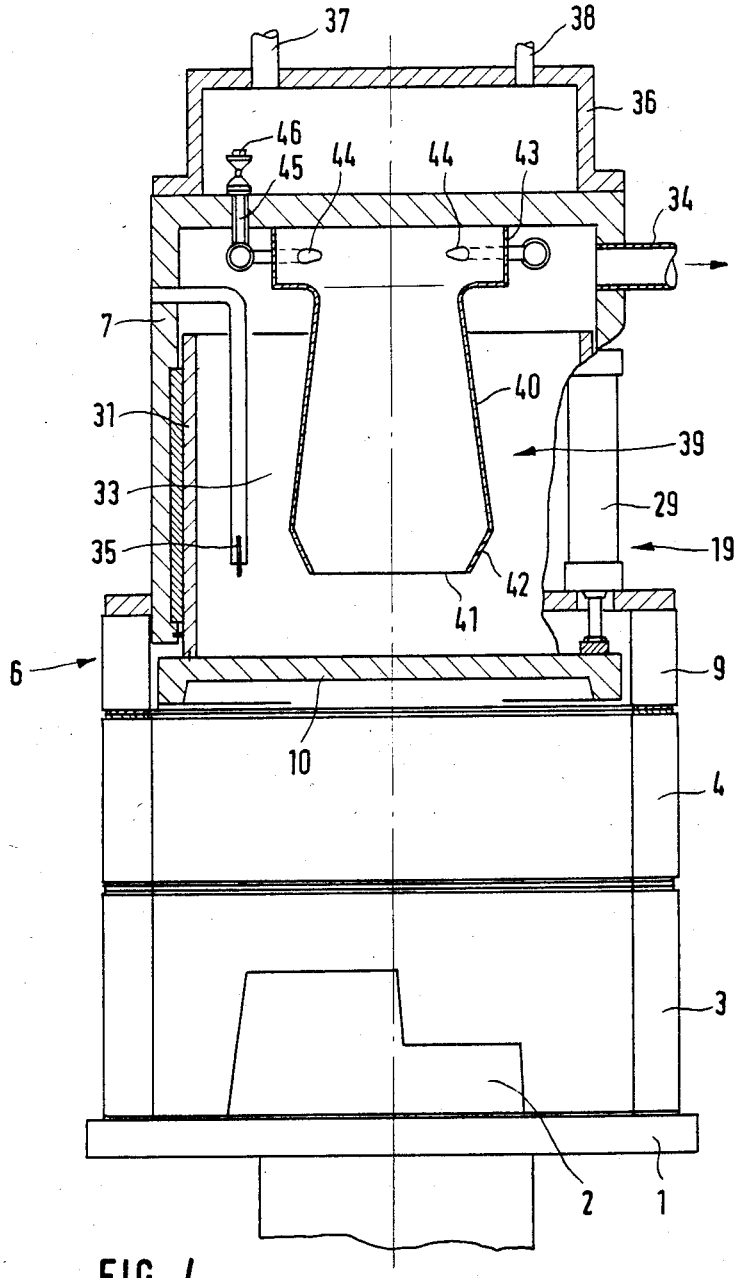
FIG. 4 is a view of another example of an apparatus for use with explosive mixtures.

In FIG. 4 a form of the apparatus is to be seen designed for use with explosive mixtures. The piston plate 10 again has a guide cylinder 31, whose inner part forms parts of the explosion chamber 33 within the pressure receiver 7. The explosion chamber 33 furthermore has a blast-off opening 34 and an ignition means 35. There is a smaller storage container 36 mounted on the pressure receiver 7 in this example of the invention in order to separately take up the necessary amounts of the gas components at a low gage pressure as needed by way of the connections 37 and 38. There is a free turbulence mixer 39 in the explosion chamber 33, such mixer being mainly made up of a large diameter mixing tube 40 whose first part widens conically. A short length 42 of the mixing tube 40 near the lower opening 41 is tapered or drawn inwards, while the top part of the mixing tube 44 widens out as a cylindrical ring 43, into which the one or more ducts 44 open tangentially and possibly in opposite directions to each other. These ducts 44 join up by way of a ring duct and a header duct 45 with the storage container 36 and are shut off therefrom by a valve 46. After opening the valve 46 the pre-mixed gas flows out of the storage container 36 and the ducts 44 with a spin into the top part 43 of the free turbulence mixer 39 so that the gas spirals down along the inner face of the mixing tube 40, while at the same time a part of the gas returns in the middle of the opening 41. A certain amount of the gas comes out through the opening 41 and goes into the explosion chamber 33. After pressure equalisation has taken place between the storage container 36 and the explosion chamber 33 the mixture is ignited and the piston plate 10 accelerated.

Figure 5:
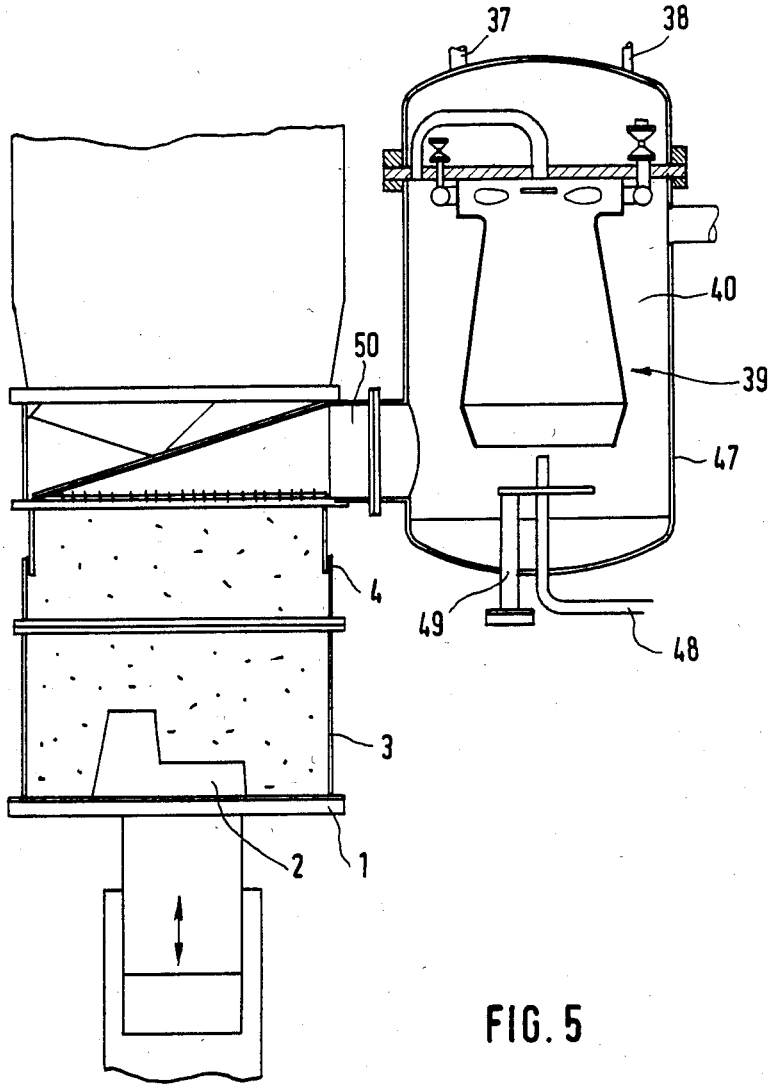
FIG. 5 is a view of a further version of the apparatus as in FIG. 4 without the piston plate.

A different version of the free turbulence mixer is to be seen in FIG. 5, in which the mixer 39 is housed in a pressure receiver 47 placed next to the mold space in the more limited sense of the wording. The supply of the gases may be on the same lines as in FIG. 4. For this purpose the connections 37 and 38 are used, or in place thereof the combustion air may be supplied by way of the connection 37 and the explosive gas by way of the duct 48. Furthermore the two designs may be combined with each other. In the working example figured the ignition means 49 is placed in the lower part of the pressure receiver 47 and in this case the pressure front or wave of the explosion is propagated by way of a duct 50 with a large diameter into the space over the piston plate (not marked) accelerating same in the way noted.

We claim:

1. An apparatus for compaction of molding sand by gas pressure, the apparatus comprising an enclosed gas space containing gas under pressure sealed by a sealing means and a mold area located therebelow, the mold area including a mold box closed at a bottom thereof by a pattern plate with a pattern thereon, a filling frame on a top of the mold area, a space above an upper surface of the molding sand heaped on said pattern, a piston plate is disposed a short distance above the upper surface of the molding sand, said piston plate forming said sealing means of said enclosed gas space and separating said space above the surface of the molding sand from the enclosed gas space, said piston plate being freely movable under the effect of the pressure of the gas in the enclosed gas space so that the gas disposed between the piston and the molding sand becomes compressed in a range of milliseconds and the sand undergoes compaction, a circumference of said piston plate is approximately equal to an inner cross sectional area of said filling frame, means for moving the piston plate to an initial position above the surface of the molding sand after the molding sand is compacted, and means for releasably locking the piston plate in the initial position.

2. The apparatus as claimed in claim 1, wherein said means for moving said plate into the initial position comprises a return mechanism, said piston plate being placed in its initial position directly over a top edge of said filling frame.

3. The apparatus as claimed in claim 1, wherein said piston plate is made in the form of a free-flight piston.

4. The apparatus as claimed in claim 3 comprising power drive means for releasing said locking means.

5. The apparatus as claimed in claim 1, wherein said releasable locking means comprises means operated by gas pressure.

6. The apparatus as claimed in claim 1, comprising shock absorber means placed in a path of motion of said piston plate and designed to brake it when same has been moved through a given compaction stroke.

7. The apparatus as claimed in claim 6, wherein said shock absorber means is adapted to be adjusted for varying the compaction stroke.

8. The apparatus as claimed in claim 1, wherein said piston plate has at its edge a downwardly running skirt.

9. The apparatus as claimed in claim 1, wherein said piston has a lower side that is sloped upwards towards a middle point of said plate.

10. The apparatus as claimed in claim 1, wherein said piston plate has transfer passages and means for opening same during such compaction stroke.

11. The apparatus as claimed in claim 10, wherein said transfer passages are positioned between said piston plate and an inner wall face of said filling frame, said apparatus further comprising passage overlapping sealing means for shutting off said transfer passages under the action of the said gas under pressure.

12. The apparatus as claimed in claim 10, wherein said transfer passages are in said piston plate, said apparatus further comprising closure means for shutting off said transfer passages, at least in the initial position of said piston plate..

13. The apparatus as claimed in claim 1 wherein said piston plate comprises a guide piston extending into said enclosed gas space.

14. The apparatus as claimed in claim 13, wherein said guide piston is in the form of a guide cylinder forming a part of means defining said gas space.

15. The apparatus as claimed in claim 14, wherein said guide cylinder is in the form of cylinder with a circular cross section and has transfer passages adapted to produce, after the start of a compaction stroke, a connection between the enclosed gas space and the space still disposed between the piston and the molding sand.

16. The apparatus as claimed in claim 1, wherein said piston plate is exchangeable against other such piston plats for adaption of the piston plate with respect to one of the group comprising: the mass of the plate, the shape thereof in connection with different patterns, the cross section of the flask.

17. An apparatus for compaction of molding sand by gas pressure, the apparatus comprising a flask, a pattern plate and pattern thereon, said pattern plate forming a lower floor of said flask, a filling frame placed on said flask and forming an enclosure in which there is an enclosed gas space above an upper surface of the molding sand heaped on said pattern, a piston plate positioned a small distance over said heaped sand and adapted to separate, at least at the beginning of said compaction under the action of gas in said enclosed gas space, the sand from the space over said piston plate, said piston plate being adapted to move freely while under the effect of gas pressure over said piston plate and thereby apply pressure to said enclosed gas space so that said gas in said enclosed gas space becomes compressed in a time period in an order of milliseconds and said molding sand undergoes compaction, said piston plate having an outline corresponding to an inner cross-section of the enclosure, and means for moving said piston plate back to an initial position thereof, said gas pressure is generated by producing an explosive gas mixture in said space over said piston plate, components of said gas mixture are mixed in said space over said piston plate by being blown therein in the form of a vortex so that they are mixed by free turbulent flow, and wherein free tubulence mixing means are placed in said space over said piston plate, said mixing means being composed of a downwardly widening mixing tube with a lower open end and tapering inwards at such open end and widening out in the form of a hollow ring at a top closed part thereof, and a tengential inlet opening in said hollow ring for at least one gas component.

18. The apparatus as claimed in claim 17 further comprising means defining a space over said free turbulence mixing means for storing the requisite amount of at least one of the gas components at a gage pressure for explosion, said component transferring into said hollow ring while a further gas component is being blown into the same.

* * * * *